United States Patent [19]

Aono et al.

[11] Patent Number: 4,982,134

[45] Date of Patent: Jan. 1, 1991

[54] VIDEO DISPLAY DEVICE

[75] Inventors: Hiroshi Aono; Mitsunori Yokomakura, both of Takatsuki; Keiji Nagata, Hirakata, all of Japan

[73] Assignee: Matsushita Electric Industrial Co., Ltd., Kadoma, Japan

[21] Appl. No.: 426,705

[22] Filed: Oct. 26, 1989

[30] Foreign Application Priority Data

Oct. 26, 1988 [JP] Japan ..... 63-269915
Oct. 28, 1988 [JP] Japan ..... 63-273546
Oct. 28, 1988 [JP] Japan ..... 63-273555

[51] Int. Cl.[5] ..... H01J 29/04; H01J 19/12

[52] U.S. Cl. ..... 313/456; 313/422; 313/277

[58] Field of Search ..... 313/422, 456, 293, 271, 313/277, 278, 292, 302, 343

[56] References Cited

U.S. PATENT DOCUMENTS

Re. 31,876 4/1985 Watanabe et al. ..... 315/366
2,813,772 11/1957 Zaphiropoulos ..... 316/19
3,513,348 5/1970 Randmer et al. ..... 313/277 X
4,158,210 6/1979 Watanabe et al. ..... 358/56
4,356,427 10/1982 Noguchi et al. ..... 313/422
4,404,493 9/1983 Nonomura et al. ..... 313/422
4,535,272 8/1985 Ueda et al. ..... 315/366
4,542,322 9/1985 Irie et al. ..... 315/366
4,812,716 3/1989 Miyama et al. ..... 313/422 X

FOREIGN PATENT DOCUMENTS 0266772 5/1988 European Pat. Off. .
0286911 10/1988 European Pat. Off. .

*Primary Examiner*—Sandra L. O'Shea
*Attorney, Agent, or Firm*—Wenderoth, Lind & Ponack

[57] ABSTRACT

This invention relates to a video display device in which the image area of the screen is divided into multiple sectors in the vertical direction and an electron beam is vertically deflected at each of these sectors to display multiple image lines, and particularly to a construction of cathode wires suspended horizontally in order to generate an electron beam at each sector. In this invention, distance between the wire cathodes and back electrode and also between the wire cathodes and the control electrode are held constant by providing insulated members under the wire cathodes.

6 Claims, 4 Drawing Sheets

VIDEO DISPLAY DEVICE

BACKGROUND OF THE INVENTION

1. Field of the Invention

The present invention relates to an image display device for video equipment, and particularly to a support mechanism for the cathode wires in such a display device.

2. Description of the Prior Art

Cathode ray tubes (CRTs) have conventionally been used for the display element in color television monitors, but a conventional CRT is extremely deep in proportion to the screen area, and this has made it impossible to manufacture a thin television receiver. While electroluminescent display elements, plasma display elements, and liquid crystal display elements have been developed for use in flat display devices, these elements offer insufficient brightness, contrast, and color reproducibility, and the development of such elements which are practical for use in television receivers is still far off. A new video display device designed to display color television images using electron beams in a flat display device has therefore been proposed. This device divides the screen display area into multiple sectors in the vertical direction, and deflects an electron beam to each sector in the vertical direction to display multiple lines. This screen is also divided into multiple sectors horizontally; red, green, and blue (RGB) fluorescent materials in each sector are sequentially illuminated. The irradiation of the RGB materials by the electron beam is controlled by the color video signal, thus achieving a television image display element. Display devices such as these are described in U.S. Pat. Nos. 4,158,210, 4,404,493, and 4,535,272.

A conventional display device is described below with reference to FIGS. 1 and 2, in which reference number 1 is the wire cathode serving as an electron beam source; 2*a* and 2*b* are support frames which support and secure both ends of cathode wires 1; 3 is a mesh-shaped control electrode; 4 is the fluorescent material; 5 is the back electrode; 6*a* and 6*b* are the containers; and 7 is the spring which applies a tension to each cathode wire 1.

A display device so constructed operates as described below.

The wire cathodes 1, which are the electron beam source, are suspended across the display in the horizontal direction and held by flat springs 7 mounted to support frames 2*a* and 2*b*. Thus, electron beams are emitted linearly from wire cathodes 1 in the horizontal direction across the screen. Multiple cathode wires 1 are provided at an appropriate interval across the screen (only seven wires are shown in FIG. 1).

In FIG. 2, an enlarged view of the cathode wire 1 suspension construction is shown. Each of cathode wires 1 is secured by one of springs 7, which are supported by insulated support frame 2*b*, which in turn are mounted to back electrode 5. It is important to maintain a predetermined distance between each cathode wire 1 and control electrode 3, and also between each cathode wire 1 and back electrode 5 in order to eliminate variations in picture brightness. Therefore, an optical measuring instrument or similar device is used to monitor the pitch dimension and depth dimension while processing each of V-grooves 8 to obtain a precision of several microns. The cathode wires 1 may be of various materials, one of which is a tungsten wire 10 to 20 microns in diameter coated with an oxide cathode material. A control pulse is applied to the cathode wires 1 to generate an electron beam sequentially from each wire cathode 1 for a predetermined time period, and a heat current is applied during the intervals between the electron beam emission periods to maintain the cathode wires 1 at the temperature required for electron beam emission. Furthermore, when operation is started, the control pulse controlling electron beam emission and the heat current are applied to cathode wires 1 at the same time.

The back electrode 5 suppresses the generation of an electron beam from the cathode wires 1 other than the one which is currently producing the electron beam, and operates so that the generated electron beam is emitted in the forward direction towards the screen.

The mesh-shaped control electrode 3 has a long horizontal slit opposite each of the cathode wires 1; the electron beams are passed through these slits and simultaneously deflected vertically or horizontally by an electromagnetic field.

The fluorescent material 4 is painted in a striped pattern on the display surface of the housing in a vertical direction so that there is one pair each of the red, green, and blue fluorescent bodies for each single electron beam arrayed horizontally.

After these component materials are inserted to housing members 6*a* and 6*b*, the housing is sealed with flit or a like material, and a vacuum is formed inside the panel.

In a conventional display device as described above, it is important to maintain a predetermined spacing between the cathode wires 1 and control electrode 3, and between cathode wires 1 and back electrode 5 as previously described. Any error in this spacing may produce uneven luminance in the displayed image. According to the prior art, the V-grooves are therefore provided as previously described to control this spacing. Thus, according to the prior art, it is necessary to form grooves with high preciseness, but would result in poor productivity. In addition, because the wire contact area is great and the cathode wires 1 are extremely thin, the cathode wires 1 also break relatively easily.

SUMMARY OF THE INVENTION

The object of the present invention is therefore to provide an image display device which can easily maintain a constant spacing between the cathode wires and control electrodes, thereby eliminating uneven brightness problems causing image defects.

Another object of the present invention is to provide an image display device in which the wire contact area in the groove is reduced, thereby eliminating problems of broken cathode wires.

In order to achieve the first objective described above, the first embodiment of the present invention has the following features:

(a) the wire cathode is secured outside the end of the groove in an insulated support frame in which the grooves are provided, thus wire cathode is secured substantially outside the image display area;

(b) the wire cathodes contact the outer surface of an insulated member provided inside the insulated support frame; and (c) the wire cathode is positioned above the bottom of the groove in the insulated support frame.

In addition to the above features, the second embodiment of the present invention has the following feature:

(d) the grooves in the insulated support frame are cut in a slanted manner with respect to the direction of extension of the wire cathode across the image display area.

In addition to the above features, the third embodiment of the present invention has the following feature:

(e) the groove in the insulated support frame is stepped or curved to guide the wire cathode non-linearly.

According to the present invention, the spacing between the cathode wires and the control electrode, or the spacing between the cathode wires and back electrode is controlled by the outside diameter of the insulated member, and the cathode wire pitch, i.e., the distance between the cathode wires themselves, is controlled by the contact of the cathode wires at side faces of the grooves in the insulated frame member. Thus, precise height and pitch of the cathode wires are obtained easily. Thus, the brightness variations caused by the miss positioning of the cathode wires can be eliminated easily. Furthermore, because the position at which the cathode wires are held is above the bottom of the grooves, in other words, because the cathode wires are not in contact with the bottom of the grooves, contact resistance is greatly reduced. Thus, the cathode wires do not break, thereby eliminating deterioration of the picture quality due to broken cathode wires.

According to the second embodiment, the grooves in the insulated frame member contact the cathode wires at a predetermined angle because the grooves are cut at an angle to the frame. These cut grooves also control the position and the cathode wire pitches, and thereby eliminating variations in brightness. Moreover, since the grooves are cut at an angle which is smaller than the angle of the cathode wires extending to the clamping springs, the contact resistance is reduced, thereby preventing the cathode wires from breaking, and resulting in elimination of picture defects caused by broken cathode wires.

According to the third embodiment, variations in picture brightness are eliminated because the wire cathode is suspended at two points, the corner at the end of the groove and the corner of the step in the stepped groove provided in the insulated frame member, to control the cathode wire pitches. Moreover, the contact resistance of the wire cathode is reduced and the wire does not break because the contact angle of the wire cathode to the groove is reduced by contacting the groove at two corners of the stepped groove, and picture defects caused by a broken wire cathode do not occur.

DESCRIPTION OF PREFERRED EMBODIMENTS

Figure 1:
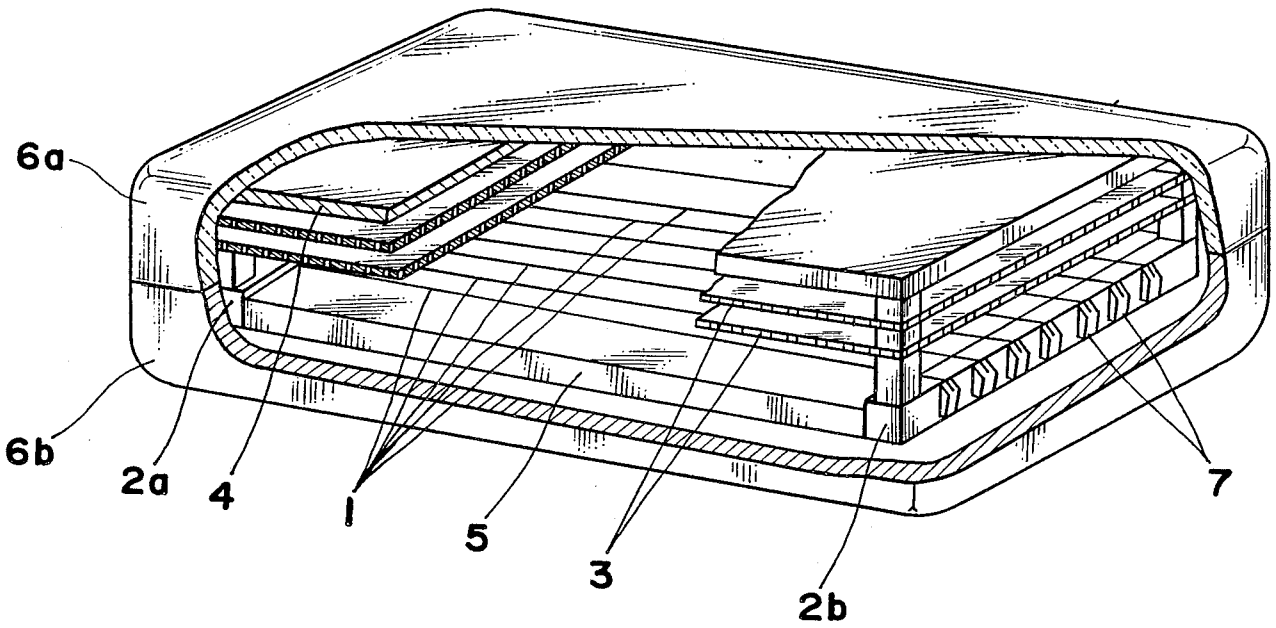
Fig. 1 PRIOR ART
FIG. 1 is a perspective view partly broken of a prior art image display device.
Figure 2:
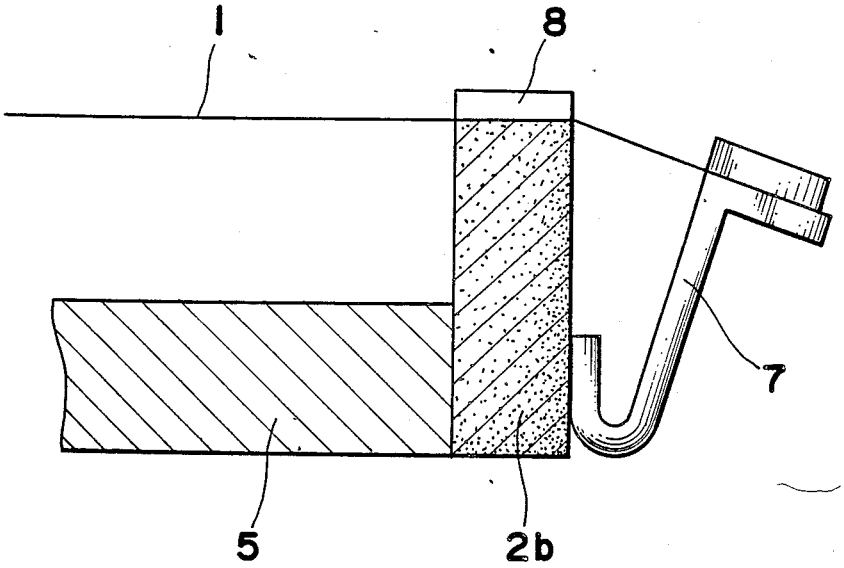
Fig. 2 PRIOR ART
FIG. 2 is a fragmentary view of the image display device shown in FIG. 1.
Figure 3:
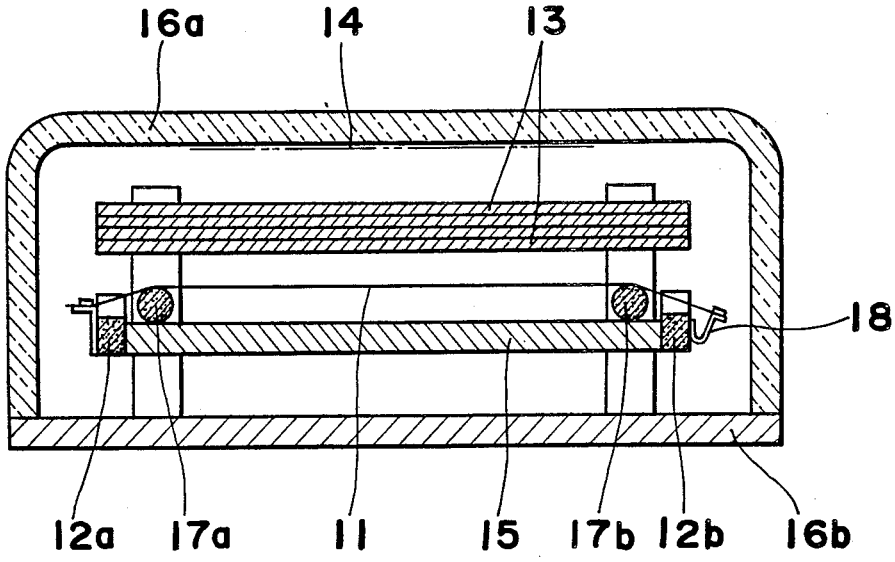
FIG. 3 is a cross sectional view of an image display device according to a first embodiment of the present invention.

Referring to FIG. 3, a cross sectional of an image display device according to a first embodiment of the present invention is shown. In the drawings, reference number 11 designates a conductive wire cathode coated with barium oxide or another material having a thermionic emissions capability; 12*a* and 12*b* are insulated support frames positioned on both sides of back electrode 15 and used to support and clamp both ends of wire cathodes 11; 13 is the control electrode used to control the electron beam emitted from the wire cathodes 11 to form the defined image; 14 is the fluorescent material which emits light and displays an image when the electron beam which has passed through the control electrode 13 collides into the fluorescent material 14; 15 is the back electrode, which is installed so that thermions can be easily emitted from the wire cathodes 11; 16*a* and 16*b* are the housing; 17*a* and 17*b* are the rod-shaped insulated members which determine the height of the wire cathodes 11; and 18 is the spring which applies a load and tension to the wire cathodes 11. For example, insulated support frames 12*a* and 12*b* and rod-shaped insulated members 17*a* and 17*b* are made of ceramics, back electrode 15, springs 18 and bottom portion 16*b* of the housing are made of metal, and cover portion 16*a* of the housing is made of glass.

FIG. 3 particularly shows the bridged suspension construction of the wire cathodes 11 in an image display device according to a first embodiment of the present invention.

As apparent from FIG. 3, wire cathodes 11 is supported by insulated members 17*a* and 17*b* so that the height of wire cathodes 11 is controlled by the diameter of insulated members 17*a* and 17*b* positioned on back electrode 15. Thus, a predetermined distance is provided between wire cathodes 11 and back electrode 15 and also between wire cathodes 11 and control electrode 13.

Figure 4:
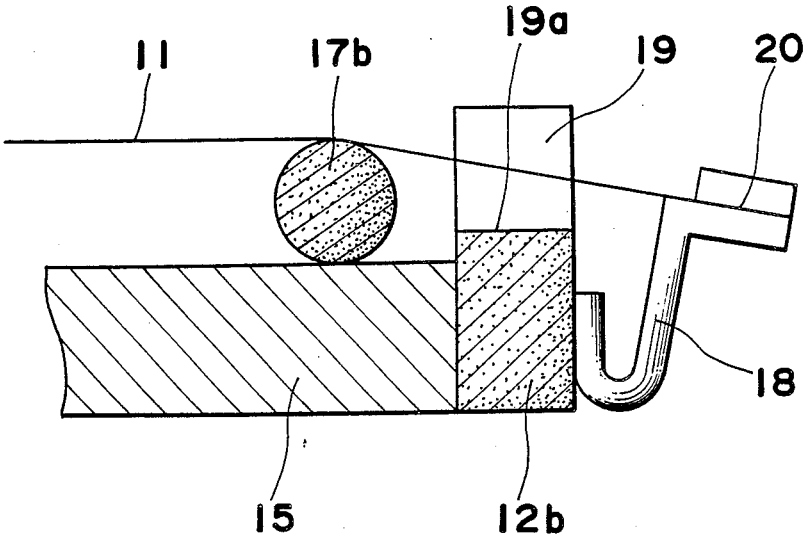
FIG. 4 is a fragmentary view of the image display device shown in FIG. 3.

It should be noted that insulated members 17*a* and 17*b* are positioned outside the edges of the image display area (specifically fluorescent material 14), and inside of insulated support frames 12*a* and 12*b*. Grooves 19 are formed in insulated support frame 12*b*. Unlike the grooves provided in a conventional flat display device, these grooves 19 do not control both the height and wire cathode pitch, but controls only the wire cathode pitch. As a result, it is sufficient to manufacture the grooves to the required precision for the pitch between the cathode wires only, and manufacturing is therefore easier. Thus, it is not necessary to manufacture the grooves with a depth precision of within several microns. In other words, both the height and cathode pitch are controlled with sufficient precision, but by different means. Specifically, the height of the cathode wires is controlled by clamping the wire cathodes 11 in contact with the insulated members 17*a* and 17*b*, and the wire cathode pitch is controlled by the edge of the grooves. Furthermore, as shown in FIG. 4, because the position at which the wire cathodes 11 are clamped is at the face 20 of the spring 18, which is above groove bottom surface 19*a*, in other words, because wire cathodes 11 are not in contact with groove bottom surface 19*a*, the height and cathode pitch precision do not become misaligned. Moreover, because wire cathodes 11 are not in contact with groove bottom surface 19*a*, the contact resistance can also be reduced. The wire cathodes 11 are suspended and secured with a predetermined tension applied by spring 18. In FIG. 4, reference number 20 shows the position at which the wire cathode 11 is clamped. The image display device is completed by assembling a control electrode 13 with the back electrode 15 assembled as thus described, and sealing the assembly in housing 16*a* and 16*b*.

Figure 5:
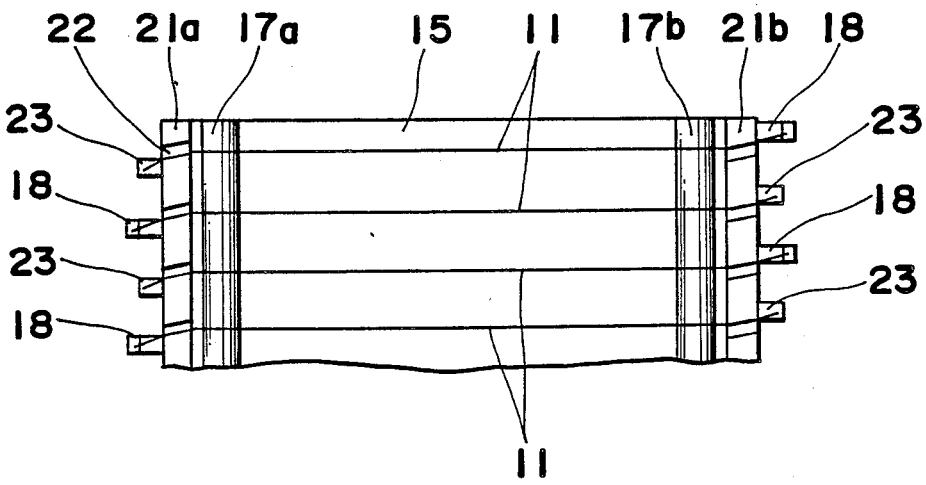
FIG. 5 is a top plan view of the back electrode block of an image display device according to a second embodiment of the present invention.

Referring to FIG. 5, a second embodiment according to the present invention is shown. The insulated support frames 21*a* and 21*b* are provided with slanted grooves 22 which each is slanted in a predetermined angle $\theta 1$ with respect to the direction of extension of the wire cathode across the screen. The required manufacturing precision can be provided by obtaining the required precision in the pitch precision between the wire cathodes 11 by means of slanted grooves 22. By using insulated members 17*a* and 17*b*, it is not necessary to manufacture the depth of slanted grooves 22 to the same micron precision as is required in a conventional flat display. The height is determined by clamping wire cathodes 11 to insulated member 17*b*. The cathode pitch is determined by the edge of slanted grooves 22. Thus, the cathode height and pitch are determined by separate means.

Figure 6:
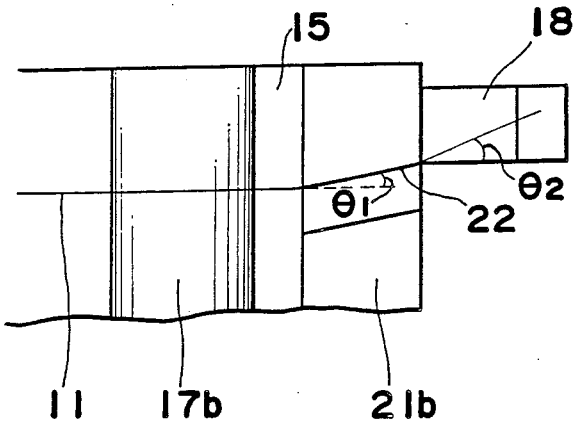
FIG. 6 is an enlarged fragmentary view of the image display device shown in FIG. 5.

As shown in FIGS. 5 and 6 according to the second embodiment, when wire cathodes 11 contact the edge of slanted grooves 22 provided in insulated support frames 21*a* and 21*b* with the opposite ends thereof being clamped by springs 18 and seats 23, the spring 18 and seats 23 are shifted to a position offset from the end of slanted grooves 22 at a further angle $\theta 2$ ($\theta 2 > \theta 1$). This offset assures that the wire cathodes 11 are firmly in contact with the end of slanted grooves 22. Furthermore, since the angle $\theta 1$ of slanted grooves 22 is less than the angle $\theta 2$, wire cathodes 11 smoothly contact slanted grooves 22. The contact resistance on slanted grooves 22 can thereby be reduced, thus preventing breakage of the wire cathodes 11 and providing the precision required in the wire cathode pitch.

Moreover, because the insulated support frames 21*a* and 21*b* are of the same shape, the insulated support frames 21*a* and 21*b* and slanted grooves 22 provided at both ends of the wire cathodes 11 are point symmetrical. Thus, reducing the moment force acting on the wire cathodes 11, improving the suspension linearity of wire cathodes 11, and improving the precision of the wire cathode pitch. The wire cathodes 11 are tensioned and clamped by the springs 18 and the seats 23.

Figure 7:
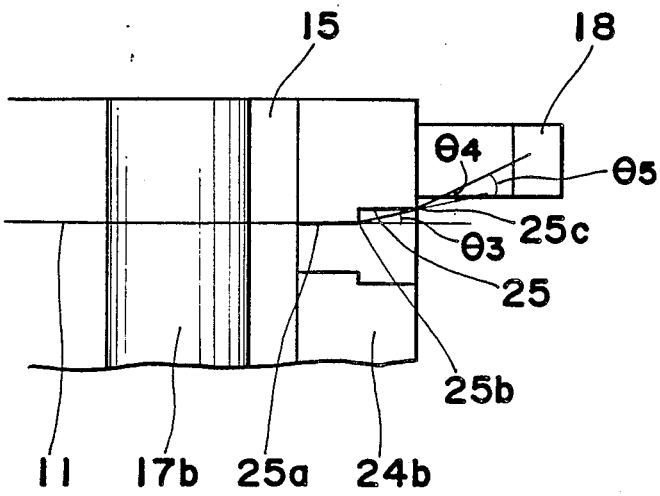
FIG. 7 is an enlarged fragmentary view similar to FIG. 6, but shown according to a third embodiment of the present invention.

Referring to FIG. 7, a third embodiment of the present invention is shown, in which a stepped groove 25 is provided in insulated support frame 24*b*. In this embodiment, the height is controlled by insulated members 17*a* and 17*b*, and the wire cathode pitch is controlled by the end 25*a* of stepped groove 25. The height and pitch of the wire cathodes 11 are thus determined by two separate members.

As shown in FIG. 7, the wire cathodes 11 contact end 25*a* of stepped groove 25 provided in insulated support frame 24*b*, and are clamped to springs 18. Because the springs 18 are offset toward corner 25*c* of stepped groove 25 from the line of the wire cathodes 11, the wire cathodes 11 are actually in contact with end 25*a* and corners 25*b* and 25*c* of stepped groove 25. Furthermore, each of the bending angle $\theta 3$ at corner 25*b* and the bending angle $\theta 4$ at corner 25*c* of the stepped groove 25 is less than the angle $\theta 5$ ($\theta 3 + \theta 4 = \theta 5$). Thus, the wire cathodes 11 are held firmly in contact with end 25*a* and corners 25*b*, 25*c* of stepped groove 25. As a result, the contact resistance acting on the wire cathodes 11 can be reduced, thus preventing breakage of the wire cathodes 11 and providing greater than a specified precision in the wire cathode pitch.

Figure 8:
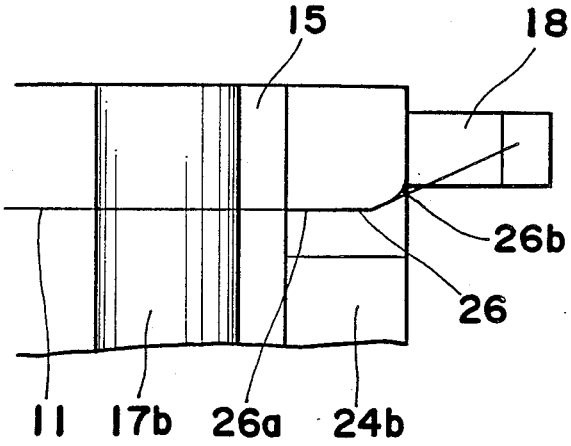
FIG. 8 is an enlarged fragmentary view similar to FIG. 7, but showing a modification thereof.

Referring to FIG. 8, an enlarged top view of a section of a fourth embodiment is shown. In this embodiment, the stepped groove 25 is replaced with a curved-edge groove 26. The wire cathodes 11 are suspended against the flat face 26*a* of curved-edge groove 26 provided on insulated support frame 24*b*, and are clamped by the springs 18. Because the springs 18 are offset from curve 26*b* of curved-edge groove 26 from the line of the wire cathodes 11, the wire cathodes 11 are in firm contact with flat face 26*a* and curve 26*b* of curved-edge groove 26.

Furthermore, because the radius of the curve 26*b* of the curved-edge groove 26 is great enough that the wire cathodes 11 are not bent sharply, the wire cathodes 11 are clamped firmly in contact with flat face 26*a* and curve 26*b* of curved-edge groove 26. As a result, the contact resistance acting on the wire cathodes 11 can be reduced, thus preventing breakage of the wire cathodes 11 and providing greater than a specified precision in the wire cathode pitch.

As described herein above, the distances between the back electrode and cathode wires and between the cathode wires and the control electrode are controlled by clamping the cathode wires to the outside of the edge of the groove in the insulated support frames and the image display area and in contact with an insulated member provided to the inside of the insulated support frame. The height of the cathode wires can thus be controlled with good precision. Thus, variations in screen brightness can be prevented, production yields can be improved, and costs can thus be reduced. Moreover, because the cathode wires are clamped without contacting the bottom of the grooves, the contact resistance can be reduced to prevent the cathode wires from being broken, thus preventing image defects and providing a high quality video display device.

Although the present invention has been fully described in connection with the preferred embodiments thereof with reference to the accompanying drawings, it is to be noted that various changes and modifications are apparent to those skilled in the art. Such changes and modifications are to be understood as defined by the appended claims unless they depart therefrom.

What is claimed is:

1. In an image display device having wire cathodes for emitting electrons, a control electrode for controlling the flow of the emitted electrons, a fluorescent material provided for emitting light when electrons are received and defining an image display area, and a back electrode for assisting the emission of the electrons from the wire cathodes, wherein an improvement of said image display device comprising:

first and second insulated support frames provided at opposite ends of said back electrode, said insulated support frames being formed with grooves for receiving said wire cathodes;

first and second insulated members provided on the back electrode at places outside of said image display area and between said first and second insulated support frames for supporting said wire cathodes; and first and second clamping means provided outside of said first and second insulated support frames for clamping opposite ends of said wire cathodes with a predetermined tension such that the wire cathodes extent above a bottom surface of said grooves in the insulated support frame.

2. An image display device according to claim 1, wherein at least one of said first and second clamping means is formed by a spring for providing a predetermined tension to said wire cathode.

3. An image display device according to claim 1, wherein said grooves are cut in a slanted manner with respect to the direction of extension of said wire cathodes across said image displaying area.

4. An image display device according to claim 3, wherein said clamping means are positioned offset from the line of the wire cathodes at the slanted grooves.

5. An image display device according to claim 1 wherein said grooves have a stepped shape with the step being widened so that the wire cathodes are suspended in contact with the step at two points which are at the corner of the end of the groove and the edge of the step.

6. An image display device according to claim 1 wherein said grooves have a curved surface so that the wire cathodes are suspended in contact with said curved surface.

* * * * *